United States Patent [19]

Snee, Jr.

[11] 4,129,172

[45] Dec. 12, 1978

[54] MOLD FOR ELECTROSLAG REMELTING PROCESS

[75] Inventor: William F. Snee, Jr., Coatesville, Pa.

[73] Assignee: Lukens Steel Company, Coatesville, Pa.

[21] Appl. No.: 736,239

[22] Filed: Oct. 27, 1976

[51] Int. Cl.[2] ..... B22D 27/04; B22D 11/124

[52] U.S. Cl. ..... 164/348; 13/35; 249/79

[58] Field of Search ..... 164/82, 79, 348, 273 R, 164/73, 89, 418, 443, 252, 443, 435, 444, 440; 13/35; 249/80, 82, 111, 89

[56] References Cited

U.S. PATENT DOCUMENTS

| | | | |
|---|---|---|---|
| 1,894,983 | 1/1933 | Eppensteiner | 164/348 X |
| 3,336,973 | 8/1967 | Ratcliffe | 164/435 |
| 3,595,302 | 7/1971 | Mallener | 164/82 |
| 3,685,571 | 8/1972 | Niskovskikh et al. | 164/443 |
| 3,763,920 | 10/1973 | Auman et al. | 164/82 |
| 3,782,445 | 1/1974 | Luchok et al. | 164/252 |
| 3,887,157 | 6/1975 | Apatoczky | 164/348 X |
| 3,941,183 | 3/1976 | Vedda et al. | 164/348 X |
| 3,981,351 | 9/1976 | Dompas | 164/348 X |
| 4,009,749 | 3/1977 | Alberny | 164/443 X |
| 4,023,612 | 5/1977 | Jackson | 164/82 |

FOREIGN PATENT DOCUMENTS

| | | | |
|---|---|---|---|
| 747977 | 10/1944 | Fed. Rep. of Germany | 164/348 |

*Primary Examiner*—Francis S. Husan
*Assistant Examiner*—John S. Brown
*Attorney, Agent, or Firm*—Mason, Mason & Albright

[57] ABSTRACT

A copper liner for a mold utilized in the electroslag refining process of a character to reduce thermal creep distortion and simultaneously increase the cooling effect obtained by circulating cold water, the liner being composed of copper and provided with a multiplicity of vertically disposed slots which may be straight or sinuous to receive cooling water, the structure between the slots dimensioned to function as cooling fins and at the same time structurally reinforce the mold liner to prevent creep.

13 Claims, 7 Drawing Figures

FIG. 1
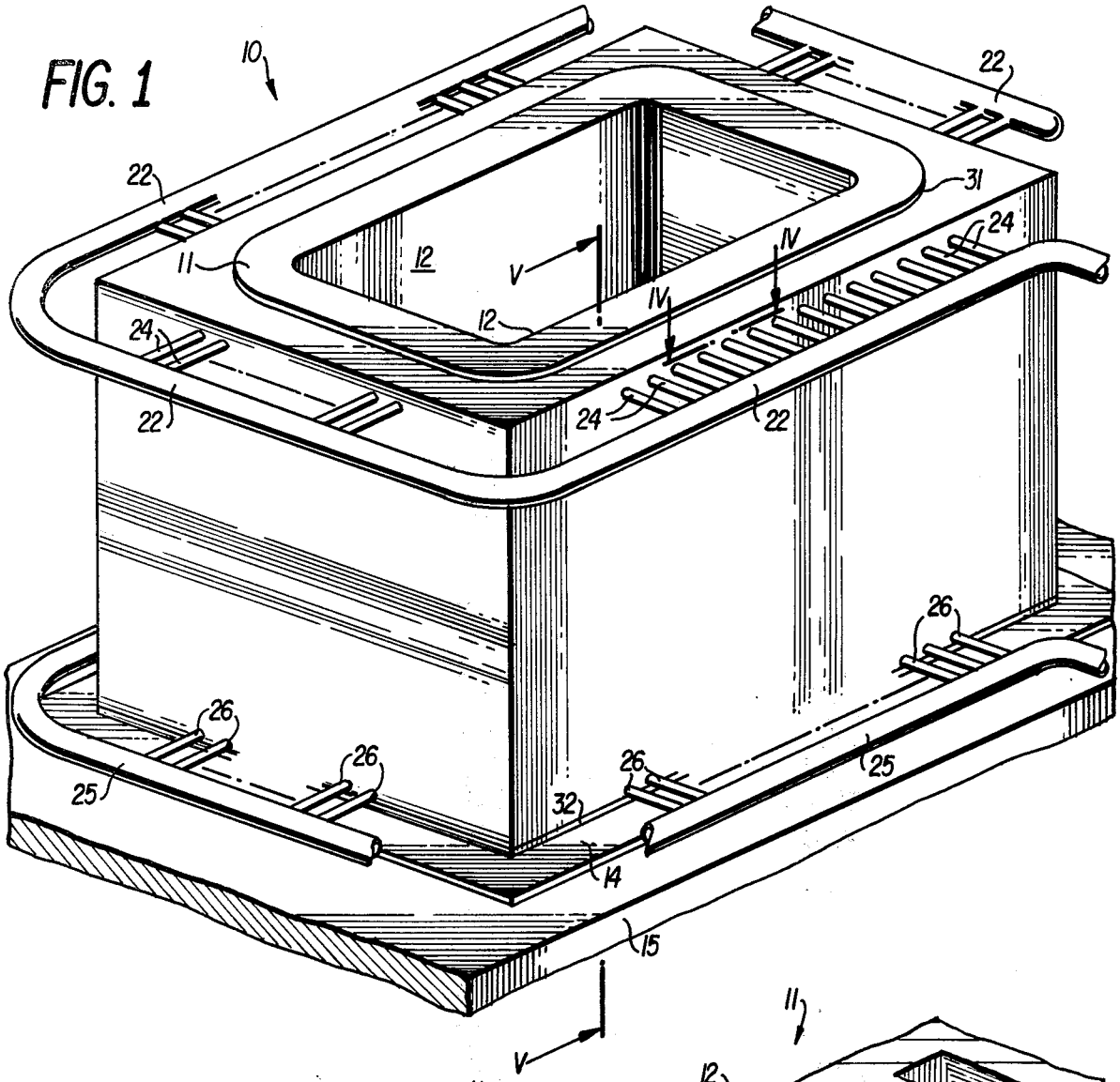
FIG. 2
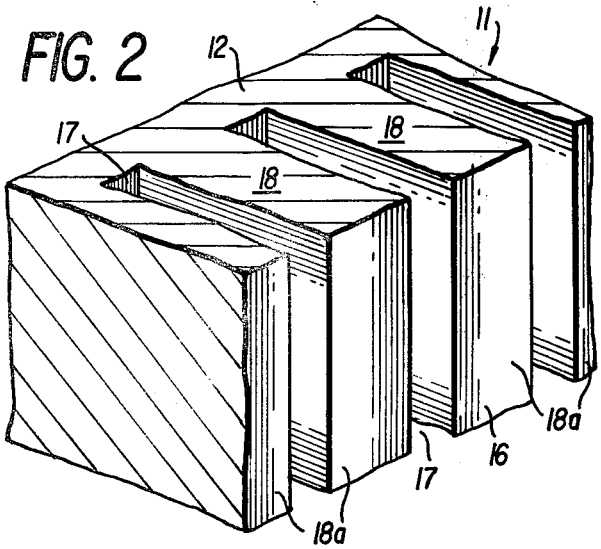
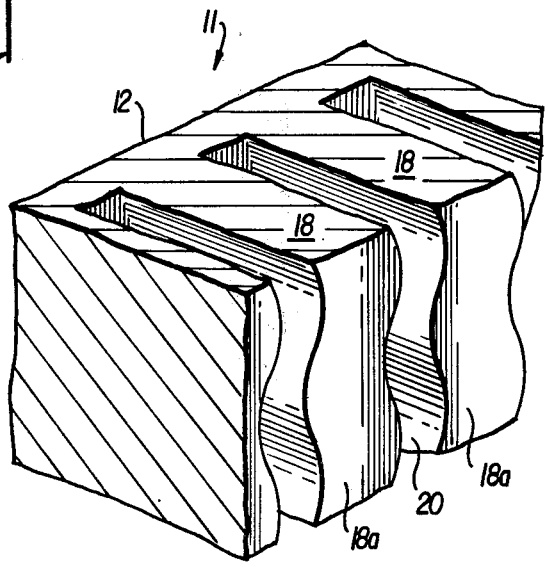
FIG. 3

MOLD FOR ELECTROSLAG REMELTING PROCESS

BACKGROUND OF THE INVENTION

The invention relates to a liner for use in a water cooled monolithic electroslag remelting mold. More specifically it is directed to a mold liner composed of copper or a copper alloy having physical characteristics which reduce thermal creep distortion in the liner structure and simultaneously increase the cooling effect provided by the coolant circulating behind the liner.

The electroslag remelting process essentially comprises the fusing of metal from a consumable electrode under a blanket of molten slag. This is generally accomplished by suspending a consumable electrode having the composition of metal desired within a water cooled copper or steel mold and introducing molten slag into the mold, the slag acting as the conductor for the electric current passing between the consumable electrode and the base plate, stool or starter plate. The current passing through the electrode in the molten slag heats the electrode and droplets of metal fuse off of its lower end and fall through the slag to the bottom of the mold where a pool of molten metal forms and solidifies upwardly from the bottom of the pool. A refining action takes place in the molten metal as it passes through the molten slag and, as the electrode is progressively consumed, refined metal builds up from the bottom of the mold to form an ingot. The molten slag floats on the pool of refined metal and is maintained in contact with the lower end of the consumable electrode. The refining process continues until the electrode is consumed or substantially consumed. Thereafter the ingot is removed from the mold.

As the slag rises in the mold, it is desirable that it form a relatively thin layer of solidified slag along the interior surfaces of the mold. It is common practice for molds used in the electroslag refining process to be water cooled and it has been found desirable that the interior lining of the mold be composed of copper because of its relatively high constant of specific heat conductivity. However, in the high temperature environment of the electroslag refining process, it has been found that copper liners have a tendency to creep thus becoming distorted and shortening their useful life. At the same time the danger of incursion of water into the molten slag is increased which, in turn, may cause hydrogen embrittlement in the resulting product. Further, the uniform quality of the ingot obtained by the process is affected by the temperature of the mold and an uneven cooling produces thermal creep with a resulting inferior quality of the steel. In addition, the non-uniformity of dimensions within the mold due to thermal creep may cause difficulty in the subsequent dislodging of the ingot from the mold.

SUMMARY OF THE INVENTION

It has occurred to the inventor that the copper or copper alloy liner for a large electroslag remelting mold might be improved by having its surface, exposed to the cooling water, slotted to provide improved cooling and at the same time uniquely to reinforce the mold's interior surface zone to reduce creep distortion. The inventor, of course, appreciates that the use of slotted molds, per se, for various purposes is known such being shown, for example, in U.S. Pat. No. 940,386 of Gathmann. A more recent patent to Stinnes, No. 3,224,860, directed to a glass forming mold, discloses an annular chamber containing a heat directing substance and an outer wall provided with ribs against which a cooling fluid is discharged by nozzles. U.S. Pat. No. 1,936,280 to Williams discloses a mold wherein side walls are provided with a plurality of longitudinally extending ribs contained in a jacket and water or other cooling fluid is introduced into the jacket space. However these prior art patents are not directed to the distinctive difficult problems which arise in the casting of the larger ingots through the electroslag remelting process. More particularly, the prior art patents are not directed to the unique problems associated with liners for larger molds in the electroslag remelting process including, specifically, the desirability to avoid distortion which occurs with the copper liners employed in such molds. Thus an important object of the instant invention is the provision of a copper alloy mold liner having vertical walls which are vertically slotted on the coolant side thereby to increase the area exposed to the cooling effects of the coolant circulating in the mold jacket and to improve the production of ingots utilizing the electroslag remelting process. A further important object of the invention is the provision of a monolithic electroslag remelting mold having a copper or copper alloy wall which effectively confines cooling water, the configuration and structure of the liner being adaptable to a variety of different flow paths whereby a maximum cooling effect may be obtained depending on the size and shape of the mold. Yet further, in combination with the above, a most important advantage of the invention lies in the structural strength provided by the relatively cooled ribs which minimizes creep distortion of the copper or copper alloy lining thus substantially increasing the effective life of the liner prior to replacement.

Other objects, advantages, adaptabilities and capabilities will be recognized as the description progresses, reference being had to the accompanying drawings, in which:

BRIEF DESCRIPTION OF THE DRAWINGS

FIG. 1 is a perspective view illustrating a monolithic mold of the type used in the electroslag refining process which incorporates the instant invention;

FIG. 2 is an enlarged view of a portion of the mold wall illustrating its vertical slots, channels or fins;

FIG. 3 is a view similar to FIG. 2 illustrating an embodiment wherein the slots have a vertical sinuous configuration;

DESCRIPTION OF THE PREFERRED EMBODIMENTS

Figure 4:
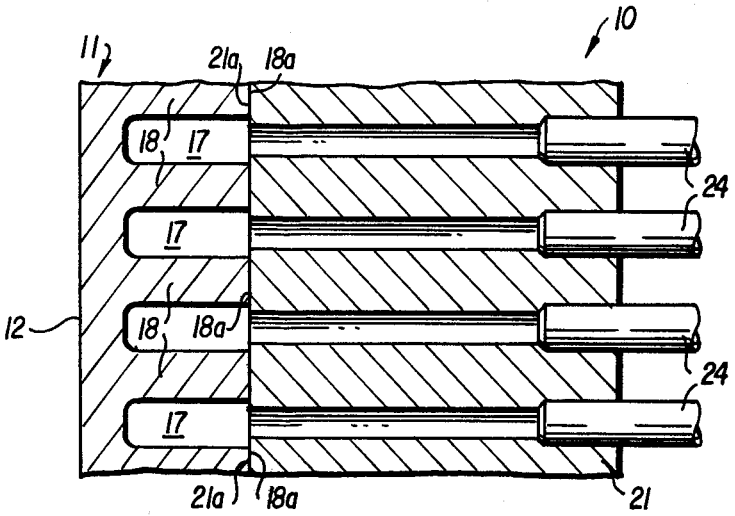
FIG. 4 is a fragmentary sectional view taken on section lines IV—IV of FIG. 1.

In the drawings, FIG. 1 illustrates a substantially conventionally shaped monolithic electroslag remelting mold 10 which is used for production of high quality metal ingots. The mold is provided with a copper alloy liner 11 which includes a surface 12 constituting the confining face of the mold. The mold has an open bottom and rests on a starter plate 14 which, in turn, is carried on the top of a mold car 15, also preferably water cooled. The top of mold car 15 may be water cooled from its underside. The starter plate 14 is usually composed of steel and receives the entire lower area of mold 10 extending beyond the outer periphery thereof. In FIG. 1, the manifolds 22 and 25 and conduits 26, preferably incorporated with mold 10, are illustrated on its exterior for the purposes of clarification.

Referring to FIG. 2, it will be seen that the surface 16 which is exposed to cooling water has a plurality of ribs 18 which define between them a plurality of slots as indicated by reference numeral 17. Slots 17 extend substantially vertically along substantially the entire area of each wall of the liner 11 and are preferably of a general character illustrated in FIG. 2 or may be serpentine as indicated by reference numeral 20 in FIG. 3.

Ribs 18, which serve the function of increasing the effectiveness of the circulating coolant, also reinforce the liner to prevent creep of the metal in the zone of surface 12. For this reason, the thickness of ribs 18 is about one and one-half to six times that of the width of slots 17. Further, they extend away from surface 12 a distance of about two to four times the width of slots 17 to maintain the metal in the zone of rib surfaces 18*a* relatively cool and rigid.

Figure 5:
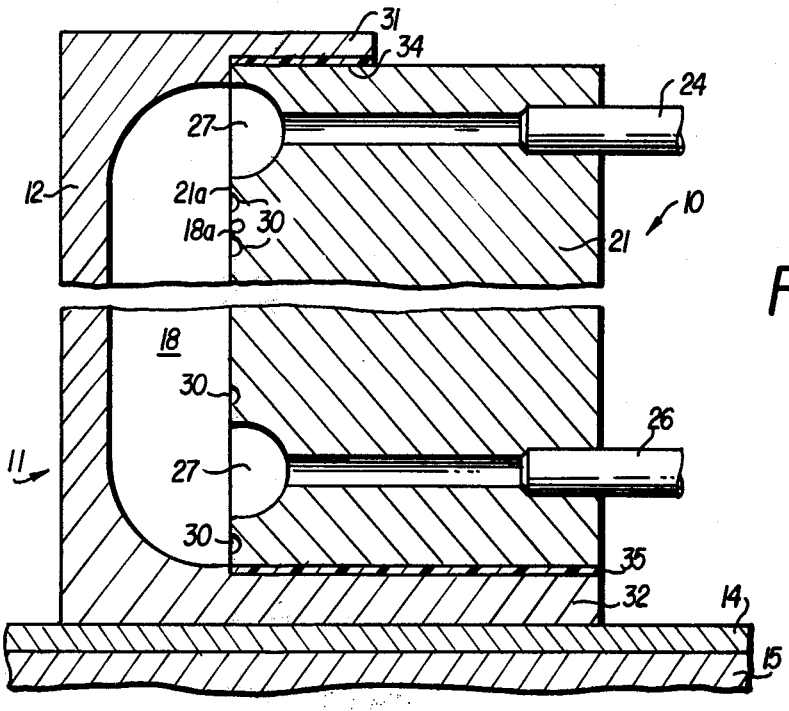
FIG. 5 is a broken elevational sectional view taken on lines V—V of FIG. 1.
Figure 6:
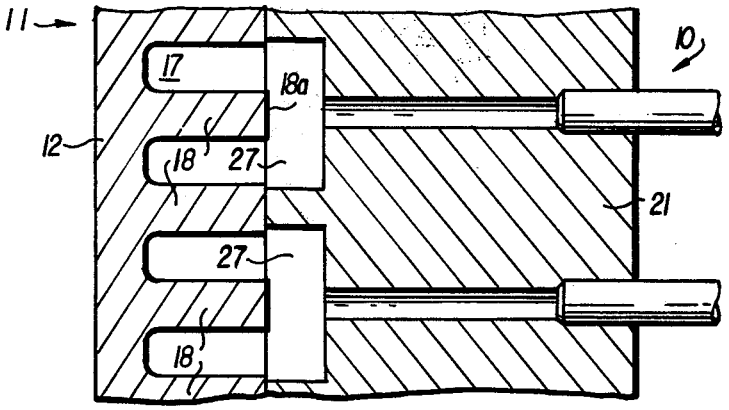
FIG. 6 is a modified embodiment shown in a fragmentary section view similar to FIG. 4.

As may be noted from FIG. 5, mold 10 includes a steel shell 21 and ribs 18 have their interior surfaces 18*a* abutting against the inward face designated 21*a* of the shell 21. Each slot 17 receives cooling water from manifold 22 via a plurality of inlets 24 which interconnect slots 17 with manifold 22. In a similar manner a discharge manifold 25 is also connected with each of slots 17 via an outlet conduit 26. Depending on the cooling need which varies in accordance with the size and interior cross-section of the mold 10, a variety of different cooling connections may be employed. Thus as shown in FIG. 4, there may be a separate inlet 24 for each slot 17. Alternatively, each pair of slots 17 may be supplied from inlet 24 via an interior confined manifold structure 27 as shown in FIGS. 5 and 6 whereby each inlet 24 supplies cooling water to a pair of slots 17. Of course, three or more slots 17 may be supplied in the same manner thus reducing the number of inlets 24 required.

In operation, the coefficient of thermal expansion of the liner 11, which is composed of copper, exceeds that of shell 21 which is composed of steel. Accordingly, as the mold becomes heated, a very tight contact is provided between the matching surfaces of the liner 11 and shell 21. Cooling in this area is, in some instances, desirable and may be obtained by providing a plurality of grooves 30 in the shell 21 as shown in FIG. 5.

Liner 11 preferably includes an upper flange 31 and a lower flange 32 with gaskets 34 and 35 respectively provided between such flanges and the top and bottom of shell 21. Through this structure, any leakage of water from within the mold is directed outside the mold rather than to its interior thereby minimizing the possibility of water or moisture entering the slag and causing hydrogen embrittlement in the resulting ingot. Also, for the same reason, it is preferred that cooling water within the slots 17 be maintained at a pressure slightly less than atmospheric pressure by connecting the manifold 25 to the inlet of a circulating or discharge pump of sufficient capacity for this purpose.

Except as necessary for the path desired, the specific locations of the inlet and discharge components are not critical and may be positioned as desired including within the shell 21.

Figure 7:
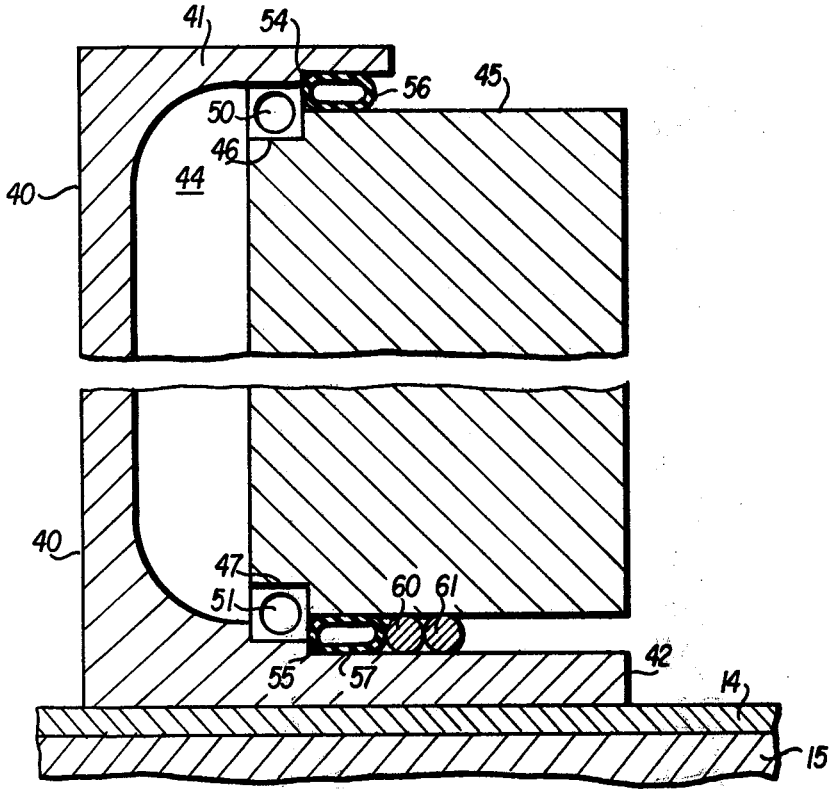
FIG. 7 is a broken elevational sectional view similar to FIG. 5 showing a further embodiment.

A modification of the invention is shown in FIG. 7 wherein a copper liner 40 includes an upper flange 41 and a lower flange 42. The rib 44 is one of a plurality of ribs which abut the outer mold shell 45. This shell 45 includes an upper offset 46 and a lower offset 47 which receive an inlet 50 and outlet 51 respectively, the offsets 46 and 47 together with ribs 44, intervening slots, a lower portion of flange 41 and an upper portion of flange 42 define manifolds whereby cooling water enters inlet 50 passes between the ribs 44 through the slots defined thereby and is discharged from the outlet 51 for subsequent cooling and recirculation. Flanges 41 and 42 are provided with steps 54 and 55 respectively which receive O-rings 56 and 57 respectively, sides of which O-rings define the manifolds otherwise defined by the liner 40 and shell 45 for inlets and outlets 46 and 47. The O-rings 56 and 57 serve to prevent leakage of coolant received between liner 40 and shell 45. At the same time, the exposure of the O-rings 56 and 57 to the coolant serves to prevent these components from becoming overheated.

In order to preclude undue pressure due to the weight of liner 45 on O-ring 57; a suitable spacer such as a pair of endless rod members 60 and 61 are provided to surround O-ring 57. As in the embodiment illustrated in FIG. 5, the mold comprised of liner 40 and shell 45 is supported by a starter plate 14 which, in turn, is supported by the top portion 15 of an underlying mold car.

A primary advantage of the system shown in FIG. 7 lies in the circumstance that only a single inlet and outlet is required for each side of the mold.

In practice, the copper liner 40 is constructed of a silver bearing copper, 28 ounces to the ton, and is 1½ inches thick with the slots each being ¾ of an inch in depth and ¼ of an inch width between adjacent ribs 44. Each rib 44 is about ¾ of an inch thick. Copper in the zone of the face of liner 40 is maintained at a temperature of about 150°–180° F. by circulation of the coolant between ribs 44 as the slag, in operation, forms a crust thereon. At the root of each slot between ribs 44, the operating temperature is about 100°–130° F. and finally at the outer face of each rib 44 where it abuts against the inner face of shell 45, the temperature is about 75°–105° F. These temperatures are maintained by an appropriate volume of circulating water having a temperature at inlet 50 of about 70° F. and at outlet 51 of about 75° F.

It has been found in practice that with the vertical positioning of the slots or fins and the appropriate dimensioning of same, the vertical distribution of water provides substantially improved uniform thermal exchange with the concommitant result of producing a higher grade steel ingot while minimizing thermal creep distortion in the copper liner. During utilization of this structure in the electroslag remelting process, a considerably saving results through extended use of the liner prior to a need to replace same.

The serpentine configuration of the slots, as shown in FIG. 3, increases even more the area of exposure of the water to the heat conducted through the liner from the molten slag metal and hot solidified metal therein.

Although the preferred embodiments of the invention are described above, it will be understood that the subject matter of the invention is capable of other adaptations and modifications within the scope of the appended claims which cover not only corresponding structure described in the specification but equivalents thereof.

I claim:

1. A monolithic mold for use in the electroslag remelting process, the mold comprising a copper liner having walls for forming an ingot of substantially uniform chemistry and physical characteristics throughout, said walls having planar-shaped inboard surfaces and vertical heat exchanging conduits provided along their outboard surfaces, said vertical conduits being defined by spaced ribs for substantially the vertical height of said walls, said ribs having a width of 1.5 to 6.0 times the width of the adjacent said conduit, fluid intake and discharge means operatively associated with said conduits to provide a vertical disposed flow of cooling fluid through said conduits, the spacing of the ribs together with their thickness and depth being such whereby a substantial portion of each said rib is maintained at a sufficiently low temperature by said cooling fluid to sustain the rigidity of said liner and to prevent substantial distortion from taking place by said walls during the electroslag refining process.

2. A mold in accordance with claim 1, wherein said ribs are sinuous.

3. A mold in accordance with claim 1, wherein said conduits are rectangular in cross-section.

4. A mold in accordance with claim 1, wherein the fluid intake means is disposed adjacent the upper region of said vertical conduits and their discharge means are adjacent the lower region of said vertical conduits.

5. A mold in accordance with claim 1, wherein a plurality of said vertical conduits are in mutual horizontal communication in the areas of intake and discharge, whereby to provide an interrelated fluid circulating system.

6. A mold in accordance with claim 1, including a shell composed of steel, said ribs abutting against said steel shell whereby a very tight contact occurs between matching surfaces of said liner and said shell during the electroslag refining process.

7. A mold in accordance with claim 1 wherein said rib portion is maintained at a temperature of not greater than about 130° F.

8. A copper liner for a mold used for electroslag remelting, the liner comprising a substantially smooth face for receiving molten slag and molten metal forming an ingot therein, an opposite face defining a plurality of ribs and adjacent slots therebetween, the width of said ribs being about 1.5 to 6.0 times that of said adjacent slots, each said rib adapted to be cooled by a coolant received in its adjacent slots and said ribs and slots being relatively dimensioned whereby the zone of said smooth face is maintained at a sufficiently low first temperature for forming the desired layer of slag in the electroslag remelting process and a substantial portion of each said rib is maintained at a sufficiently low second temperature for rigidly reinforcing and maintaining said liner structurally rigid and substantially preventing creep in said smooth face surface zone.

9. A liner in accordance with claim 8, wherein said slots and ribs are disposed substantially vertically.

10. A liner in accordance with claim 9, wherein said ribs each extend away from said smooth face surface zone a distance of two to four times the width of said slots adjacent thereto.

11. A liner in accordance with claim 10 wherein the liner is surrounded by a steel shell, the outboard ends of said ribs abutting against said shell whereby a very tight contact occurs between matching surfaces of the liner and said shell when the liner is heated by receipt of molten slag and metal in the electroslag refining process.

12. A mold for use in the electroslag refining process, the mold comprising a copper liner having walls and vertical heat exchanging conduits provided along their outboard surfaces, said vertical conduits being defined by spaced ribs which extend for substantially the vertical height of said walls, the width of said ribs being about 1.5 to 6.0 times the width of said conduits defining said ribs, cooling fluid being received in said conduits maintaining said ribs sufficiently cool to maintain their rigidity whereby they structurally support and substantially prevent distortion of said walls, a structural steel shell surrounding said liner with the outboard ends of said ribs in contact with the inboard sides of said shell, the contact between said ribs and said shell becoming very tight upon the heating of the mold as a result of the electroslag refining process whereby said liner, including said ribs, is substantially in a state of compression.

13. A mold in accordance with claim 12 wherein the temperature of a substantial portion of said rib is in a range of about 100° to 130° F. during said electroslag refining process.

* * * * *